US007150677B2

(12) United States Patent
Yamashita et al.

(10) Patent No.: US 7,150,677 B2
(45) Date of Patent: Dec. 19, 2006

(54) CMP CONDITIONER

(75) Inventors: Tetsuji Yamashita, Iwaki (JP); Takashi Kimura, Iwaki (JP); Hanako Hata, Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 11/231,545

(22) Filed: Sep. 20, 2005

(65) Prior Publication Data

US 2006/0079162 A1 Apr. 13, 2006

(30) Foreign Application Priority Data

Sep. 22, 2004 (JP) ..... 2004-274912

(51) Int. Cl.
*B24B 21/18* (2006.01)

(52) U.S. Cl. ..... 451/443; 451/444; 451/548

(58) Field of Classification Search ..... 451/443, 451/444, 442, 540, 548, 552, 54, 72, 539
See application file for complete search history.

(56) References Cited

U.S. PATENT DOCUMENTS 7,044,990 B1 * 5/2006 Ishizaki et al. ..... 51/295
2002/0127962 A1 * 9/2002 Cho et al. ..... 451/443
2004/0203325 A1 * 10/2004 Donohue ..... 451/56

FOREIGN PATENT DOCUMENTS

JP 2001-71267 A 3/2001
JP 2002-273657 A 9/2002

OTHER PUBLICATIONS

Patent Abstracts of Japan for JP2001-071267 published Mar. 21, 2001.
Patent Abstracts of Japan for JP2002-273657 published Sep. 25, 2002.

* cited by examiner

*Primary Examiner*—Jacob K. Ackun, Jr.
(74) *Attorney, Agent, or Firm*—Darby & Darby

(57) ABSTRACT

A CMP conditioner is provided in which diamond grit that is adhered to a conditioning surface so as to face and be in contact with a polishing pad of a CMP apparatus is adhered such that 111 surfaces of crystal surfaces of the diamond grit are substantially parallel with the conditioning surface and face in a direction faced by the conditioning surface.

8 Claims, 2 Drawing Sheets

CMP CONDITIONER

BACKGROUND OF THE INVENTION

1. Field of the Invention

The present invention relates to a CMP conditioner that is used in the conditioning of polishing pads of a chemical mechanical polishing (CMP) apparatus that polishes semiconductor wafers and the like.

Priority is claimed on Japanese Patent Application No. 2004-274912, filed Sep. 22, 2004, the contents of which are incorporated herein by reference.

2. Description of Related Art

For this type of CMP conditioner, a technology has been proposed, for example, in patent document 1 (Japanese Unexamined Patent Application, First Publication No. 2001-71267) in which, in a pad conditioning diamond dresser in which a single layer of diamond grit is adhered to a base metal operating surface of a disk-shaped or cup-shaped base metal by nickel plating, 70% or more of the adhered diamond grit has ridges or peaks of crystals as protruding ends. Moreover, in patent document 2 (Japanese Unexamined Patent Application, First Publication No. 2002-273657), technology has been proposed in which, in a CMP processing dresser in which diamond grit has been adhered to the surface of a base material by brazing, those projection lines of the vertical lines of the {111} face of the diamond grit crystals that are projected towards the dresser substrate fixing surface are substantially parallel with the dresser grinding direction, or this {111} face is at an angle of 15 to 75 degrees relative to the grinding surface of the polishing cloth.

However, firstly, if, as is the case in the patent document 1, a majority of the adhered diamond grit is adhered such that the protruding ends are formed by ridges or peaks of the crystals of the diamond grit, namely, by sharp portions where surfaces of adjacent crystals intersect on the surface of the diamond grit, in other words, if a majority of the diamond grit is adhered so as to protrude from the conditioning surface that is in contact with the polishing pad of the CMP apparatus in the direction faced by this conditioning surface, then although the sharpness of the grit in the initial stages of the conditioning is high and a high rate of pad polishing can be obtained, the sharp portions that form the aforementioned protruding ends end up losing their sharpness at a very early stage due to the speed of the abrasion so that the polishing rate deteriorates markedly. As a result, the lifespan of the CMP conditioner is far less than it should be. Moreover, if the ridge portions and, in particular, the peak portions of the crystals form protruding ends in this manner, as is described above, these portions end up being lost before they are worn out so that there is a possibility that the chipped fragments thereof will scratch the surface being polished of the semiconductor wafer or the like that is being polished by a CMP apparatus, and that scratches will be generated in the surface that is being polished.

On the other hand, in the CMP conditioner described in the patent document 2, for example, by making the protrusion heights and contact surfaces of each piece of grit on the {001} surface of hexahedral or octahedral diamond grit the same in a direction towards the surface of the base material, namely, towards the conditioning surface and in parallel with this conditioning surface, it is possible to make the load uniform on each piece of grit and prevent chipped fragments from being generated. In addition, by brazing the grit pieces such that, as is described above, the projection lines of the vertical lines of the {111} face are substantially in parallel with the grinding direction or, alternatively, are diagonally inclined at the aforementioned angle relative to the grinding surface, then by placing this {111} surface, which has a high degree of strength, in contact with the grit on an abrasive cloth (i.e., a polishing pad) as a cutting edge, dressing can be performed effectively, and it is difficult for chipped fragments to be generated. Moreover, scratching of the surface being polished is prevented.

However, conditioners that are used in a CMP apparatus are placed on the rotating polishing pad of the CMP apparatus so as to be in contact with the conditioning surface, and the CMP conditioner itself is rotated around a different axis from the rotation axis of the polishing pad, and is also oscillated on the surface of this polishing pad. As a result, it is not always certain that the projection lines of the vertical lines of the {111} surface of the grit that has been brazed to the conditioning surface will be parallel to the grinding direction. Moreover, if, for example, conditioning is performed with a surface other than the {111} surface facing entirely in the grinding direction, then wear occurs in the ridge lines and peak portions of this surface and the surface other than the {111} surface that is the protruding end surface of the grit and the polishing rate is markedly reduced at an early stage. In addition, chipped fragments occur in these ridge lines and peak portions and the occurrence of scratching is unavoidable.

SUMMARY OF THE INVENTION

The present invention was conceived in view of these circumstances and it is an object thereof to provide a CMP conditioner that prevents any large-scale reduction early on in the polishing rate in a CMP conditioner that is used in the conditioning for polishing pads of the aforementioned CMP apparatus, and that reliably prevents scratches from occurring in a polished surface such as a semiconductor wafer that is being polished by the CMP apparatus, and that enables stable conditioning to be performed over an extended period of time for polishing pads that are capable of forming a high-quality polished surface.

In order to solve the above described problems and achieve these objects, the present invention is a CMP conditioner in which diamond grit is adhered to a conditioning surface that faces and is in contact with a polishing pad of a CMP apparatus, wherein the diamond grit is adhered such that 111 surface of crystal surfaces of the diamond grit is substantially parallel with the conditioning surface and is made to face in a direction faced by the conditioning surface.

Accordingly, in this type of CMP conditioner, diamond grit is adhered to a conditioning surface such that 111 surface of the crystal surfaces of the diamond grit is made substantially parallel with the conditioning surface and is made to face in the direction faced by the conditioning surface, namely, are made to face in a direction facing a polishing pad in the CMP apparatus. Because these 111 surfaces form protruding end surfaces that protrude from the conditioning surface and are in contact with the polishing pad, sharp portions such as ridge line portions and peak portions between crystal surfaces of the diamond grit do not form protruding ends that protrude towards the polishing pad side. As a result, it is possible to prevent any marked deterioration in the polishing rate that is caused by these sharp portions wearing out at an early stage, and it is possible to prevent breakages occurring in these portions and to thereby prevent the broken fragments from causing scratches in a surface being polished of a semiconductor wafer or the like that is being polished by a polishing pad.

In addition, because it is the ridge line portions and peak portions between 111 surfaces, which are extremely strong and wear resistant and form the aforementioned protruding end surfaces, and other crystal surfaces, which are adjacent to the 111 surfaces, of the diamond grit that act as cutting blades and are cut into the polishing pads, and because the 111 surfaces that form protruding end surfaces remain in a state of constantly facing and being in contact with the polishing pad even if the grinding direction of the diamond grit as it grinds the polishing pad changes, the cutting blades are able to maintain excellent cutting quality, and there is little wear. Moreover, there are no broken fragments. Accordingly, according to a CMP conditioner having this structure, a high polishing rate can be consistently maintained over an extended period, and a lengthening of the conditioner lifespan can be achieved. In addition, in a semiconductor wafer that is polished by a polishing pad that has been conditioned using this conditioner, a high quality polished surface that is unscratched can be formed.

Here, it is possible to ascertain the proportion of the diamond grit that is adhered to the conditioning surface whose 111 surface is made to face in the direction faced by the conditioning surface and is parallel with the conditioning surface by measuring the X-ray diffraction intensity of crystal surfaces of this diamond grit. Namely, if the quantity of diamond grit whose 111 surfaces face in the direction faced by the conditioning surface and are in parallel with the conditioning surface that has been adhered is large, then a high X-ray diffraction intensity can be obtained for these 111 surfaces, while the diffraction intensity of the other crystal surfaces is proportionally small. Therefore, it can be understood that the higher the ratio of the X-ray diffraction intensity of the 111 surfaces (referred to below as the 111 surface detection ratio) relative to the total X-ray diffraction intensity of all of the crystal surfaces including the 111 surfaces, the greater the quantity of diamond grit that is adhered such that the 111 surfaces thereof face in the direction faced by the conditioning surface and are in parallel with the conditioning surface.

Therefore, based on this understanding, in the CMP conditioner of the present invention, on the above described conditioning surface, it is desirable that the 111 surface detection ratio when an X-ray diffraction intensity of crystal surfaces of the diamond grit is measured at a plurality of measurement positions on the conditioning surface averages 70% or more at the plurality of measurement positions. By having this type of high 111 surface detection ratio, the aforementioned effects can be more reliably exhibited. Namely, if this 111 surface detection ratio is less than 70%, then the proportion of diamond grains that are adhered with other crystal surfaces acting as protruding end surfaces, and the proportion of diamond grit that is adhered with protruding ridge lines and peak portions between adjacent crystal surfaces become relatively greater. Consequently, the concerns arise that the polishing rate will be made to deteriorate markedly at an early stage as a result of these grits, or that the possibility of scratches occurring will be increased because of breakages.

Moreover, it is possible for the diamond grit to be adhered to the entire above described conditioning surface, or for the diamond grit to be adhered in a toroidal shape having a predetermined width on an outer circumferential side of the conditioning surface. However, by forming a plurality of projections on the conditioning surface and adhering the diamond grit to these projections, it is possible to provide the 111 surfaces of the respective pieces of grit, in particular, that face in the direction faced by the conditioning surface and are in parallel with that surface with a high grinding pressure, and to thereby ensure that the ridge line portions and peak portions that form the edges of the cutting blades have an even greater degree of sharpness. Naturally, it is also possible to adhere diamond grit to the conditioning surface in a toroidal shape on an outer circumferential side, and to form the aforementioned projections on the inner circumferential side and then adhere the diamond grit thereto. Alternatively, it is also possible to form the projections over the entire conditioning surface (i.e., if grit is adhered in a toroidal shape on the outer circumferential side, then on the inner circumferential side thereof), or to form the projections such that they are arranged in a toroidal shape on the outer circumferential side of the conditioning surface.

Furthermore, particularly in a CMP conditioner in which diamond grit is adhered using a plating phase of a metal such as nickel, as is the case in the patent document 1, or in a CMP conditioner in which diamond grit is adhered by brazing using a metal brazing material, as is the case in the patent document 2, it is desirable that a tetrafluoride organic compound be coated onto the conditioning surface in order to prevent the occurrence of scratches that are caused by pieces of grit dropping off due to corrosion of the metal bonding phase in which the diamond grit is adhered even when a highly corrosive slurry is used when conditioning a polishing pad in a CMP apparatus. Namely, because this type of tetrafluoride organic compound is extremely corrosion resistant due to no $—CONH_2$, $—CH_2OH$, $—COOCH_8$, —COF, —COOH, and $—CCF_2H$ and the like, which easily react with highly corrosive slurries, being present therein, and because the metal bonding phase can also be reliably covered by an electropainting or the like, it is possible to more effectively prevent the diamond grit from falling off due to such corrosion of the metal bonding phase, and to prevent the occurrence of scratches that are the result of such falling grit.

DETAILED DESCRIPTION OF THE INVENTION

FIGS. 1 through 4 each show an embodiment of the CMP conditioner of the present invention. In these embodiments, there is provided a substantially circular plate-shaped base metal 1 that is formed from a metal material such as stainless steel and whose center is an axis O. One circular surface of this base metal 1 that is perpendicular to the axis O forms a conditioning surface 2. Diamond grit is adhered to this conditioning surface 2 so as to form a grit layer 3. This grit layer 3 is formed as a single layer by dispersing and adhering a plurality (i.e., a multitude) of the aforementioned pieces of diamond grit in, for example, a metal plating phase. A CMP conditioner in which a grit layer 3 has been formed on a conditioning surface 2 in this manner is used to condition a polishing pad by placing the conditioning surface 2 so that it faces and is parallel with the polishing pad surface of the CMP apparatus and is in contact with this polishing pad surface, and while being rotated around the axis O at a position away from the rotation axis of the polishing pad, the base metal 1 itself is also oscillated within the inner and outer circumferences of the pad surface.

Figure 1:
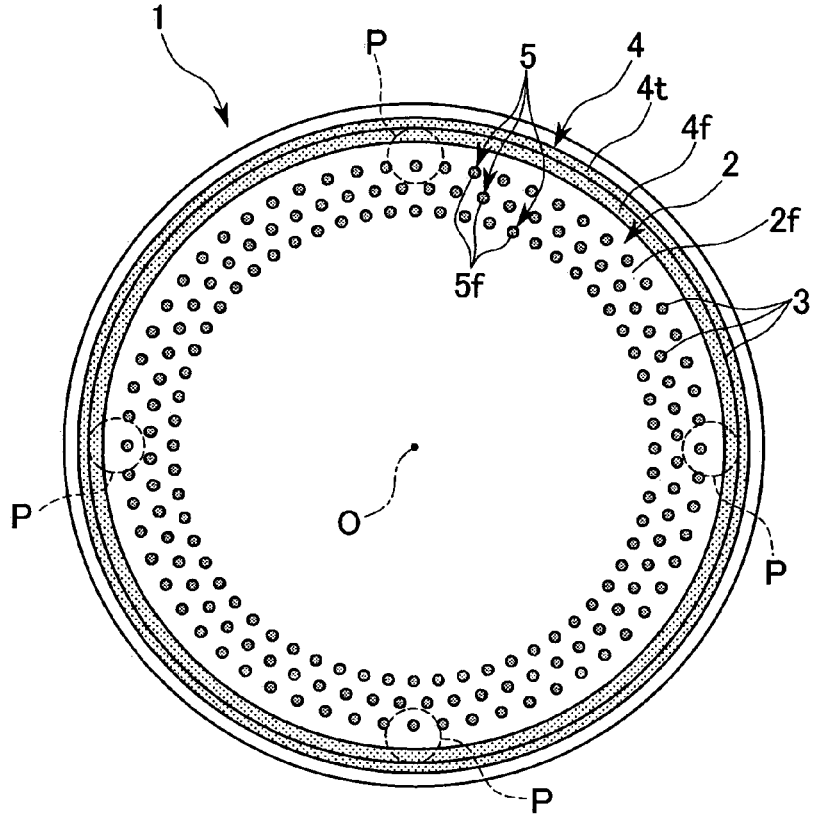
FIG. 1 is a plan view showing a conditioning surface of a CMP conditioner according to a first embodiment of the present invention.
Figure 2:
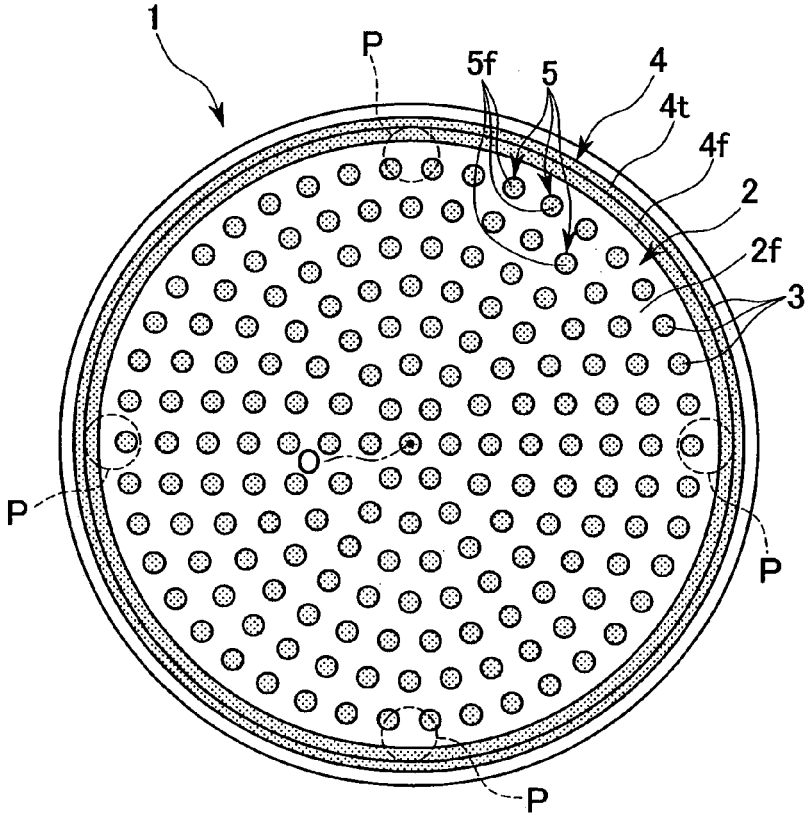
FIG. 2 is a plan view showing a conditioning surface of a CMP conditioner according to a second embodiment of the present invention.

Of these embodiments, in the first embodiment shown in FIG. 1 and the second embodiment shown in FIG. 2, a ring portion 4 that has a constant width and protrudes in a toroidal shape is formed at an outer circumferential side of the conditioning surface 2. The ring portion 4 is centered on the aforementioned axis O and has a circular ring-shaped end surface 4*f* that is parallel with the conditioning surface 2. A plurality of substantially columnar projections 5 that have circular end surfaces 5*f* that protrude to a height that is equal to the ring portion 4 and are parallel with the conditioning surface 2 are formed at intervals on an inner circumferential side of the ring portion 4. Moreover, in the first embodiment, as is shown in FIG. 1, a plurality of the projections 5 are placed only on the outer circumferential side of the conditioning surface 2 while still being on the inner circumferential side of the ring portion 4 so as to form a plurality (three in FIG. 2) of concentric circles centering on the axis O with the projections 5 being placed at equal intervals in each circle. In addition, adjacent circles are positioned so as to form a zigzag pattern with each other. In contrast, in the second embodiment, as is shown in FIG. 2, the projections 5 are arrayed across the entire inner circumference of the ring portion 4 substantially in a radial pattern centering on the axis O, and are also positioned so as to form concentric circles and be substantially equidistant from each other.

Moreover, in these first and second embodiments, the grit layer 3 is formed on the ring portion 4 and projections 5. 111 surfaces of the crystal surfaces of the diamond grit that is adhered to the end surfaces 4*f* and 5*f* of the ring portion 4 and projections 5 are placed substantially in parallel with the conditioning surface 2, namely, are placed so as to extend along a plane that is substantially perpendicular to the axis O, and are adhered so as to face in a direction faced by the conditioning surface 2, namely, in a direction facing towards the surface side of the polishing pad during the aforementioned conditioning. Accordingly, in diamond grit that has been adhered in this manner, the 111 surfaces form protruding end surfaces that protrude from the conditioning surface 2 in the direction of the axis O. Note that an outer circumferential side of the end surface 4*f* of the ring portion 4 is formed as a tapered surface 4*t* that slopes gradually towards the rear the closer it approaches to the outer circumferential side. This tapered surface 4*t* is made to intersect at an obtuse angle with the end surface 4*f* via a circular ridge line that is centered on the axis O. While diamond grit is also adhered to the tapered surface 4*t*, the inner circumferential side of the end surface 4*f* of the ring portion 4 is formed as a cylindrical surface centered on the axis O that stands vertically upright on the conditioning surface 2.

Figure 3:
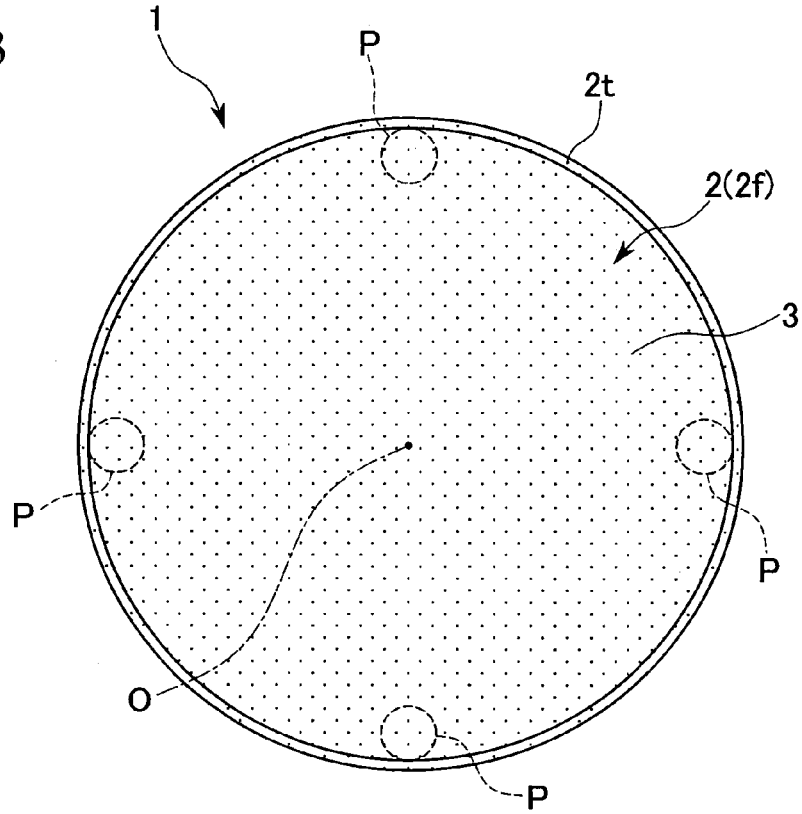
FIG. 3 is a plan view showing a conditioning surface of a CMP conditioner according to a third embodiment of the present invention.
Figure 4:
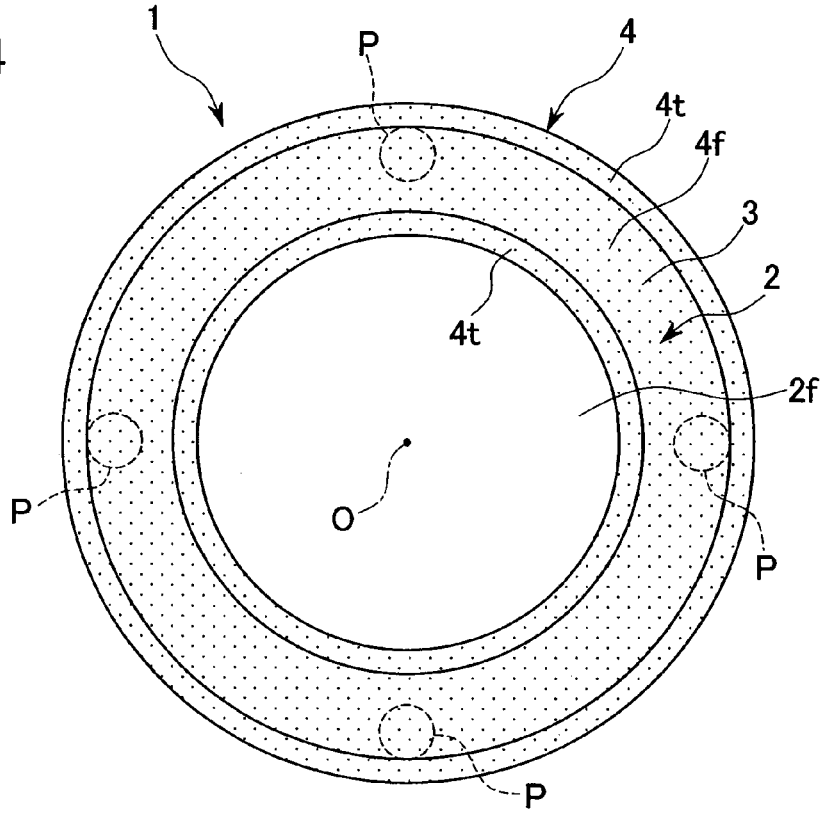
FIG. 4 is a plan view showing a conditioning surface of a CMP conditioner according to a fourth embodiment of the present invention.

In contrast, in the third embodiment shown in FIG. 3, the above described ring portion 4 and projections 5 are not formed, and the grit layer 3 is formed on the entire surface of the conditioning surface 2 that is formed as a flat plane that is perpendicular to the axis O. The 111 surfaces of the diamond grits of this grit layer 3 face the direction faced by the conditioning surface 2 and are substantially parallel with the conditioning surface 2. In the fourth embodiment shown in FIG. 4, only a ring portion 4 that is wider than the ring portions 4 of the first and second embodiments is formed on an outer circumferential side of the conditioning surface 2, and the projections 5 are not formed on the inner circumferential side thereof. In the diamond grit that is adhered to the end surfaces 4*f* of the ring portion 4 that are parallel with the conditioning surface 2, 111 surfaces face in the direction faced by the conditioning surface 2, and are made substantially parallel with the conditioning surface 2. Note that, in the fourth embodiment as well, the portion on the outer circumferential side of the end surface 4*f* of the ring portion 4 is formed as a tapered surface 4*t* that slopes gradually towards the rear the closer it approaches to the outer circumferential side, while the portion on the inner side of the end surface 4*f* is also formed as a tapered surface 4*t* that slopes gradually towards the rear the closer it approaches to the inner circumferential side. Diamond grits are also adhered to these tapered surfaces 4*t*. Furthermore, in the third embodiment, a beveled tapered surface 2*t* is formed on an outer circumferential edge of the conditioning surface 2, and diamond grits are also adhered to this tapered surface 2*t*.

However, in the diamond grit that is adhered to the end surfaces 4*f* and 5*f* of the ring portions 4 and the projections 5 in the first, second, and fourth embodiments, and the diamond grit that is adhered to the conditioning surface 2 in the third embodiment, it is possible for not all of the 111 surfaces of the diamond grits to be formed as protruding end surfaces, as is described above, in parallel with the conditioning surface 2, and also facing the direction faced by the conditioning surface 1. Alternatively, it is possible for not all of these 111 surfaces to be formed strictly in parallel with the conditioning surface 2. Here, in the first through fourth embodiments, as is shown in the respective drawings, the 111 surface detection rate when the X-ray diffraction intensity of the crystal surfaces of the diamond grit was measured at a plurality of measurement positions P on the conditioning surfaces 2 was found to average 70% or more at this plurality of measurement positions P. In other words, the diamond grits were adhered with the 111 surfaces thereof substantially parallel with the conditioning surface 2 and facing in the direction faced by the conditioning surface 2 in order that such average of 111 surface detection rate could be obtained. Moreover, in the above described first, second, and fourth embodiments, bottom surfaces 2*f* (i.e., portion between the protrusions 5 in the first and second embodiments) of each conditioning surface 2 on the inner circumferential side of the ring portions 4 are formed as flat surfaces that are substantially perpendicular to the axis O, and diamond grit is not adhered thereto. In these embodiments, the end surfaces 4*f* and 5*f* are made parallel with the bottom surface 2*f*, and, as is described above, the diamond grit that is adhered to these end surfaces 4*f* and 5*f* is adhered such that the 111 surfaces thereof are substantially parallel with the bottom surface 2*f* and face the direction faced by the bottom surface 2*f*.

Note that in order to adhere the diamond grit such that the 111 surfaces thereof are substantially parallel with the conditioning surfaces 2 and face the direction faced by the conditioning surfaces 2, for example, it is possible to array and fix each piece of grit individually on the conditioning surface 2 with the orientation of the 111 surfaces thereof all aligned, and then adhere them using the aforementioned metal plating phase or the like. However, it is also possible to select from commercial artificial diamond grit what is known as hexahedral—octahedral grit or octahedral—hexahedral grit that has large 111 surfaces, and then disperse this grit in a metal plating solution in which the base metal 1 is immersed. The metal plating phase is then precipitated while the grit is earthed to the conditioning surface 2, so that the grit is adhered by electrodeposition. Namely, because there is a strong possibility that 111 surfaces of this type of diamond grit will become closely adhered to the conditioning surface 2 side and be earthed, it is possible to adhere the diamond grit such that the 111 surfaces on the opposite side from the above adhered 111 surfaces are made parallel with the conditioning surface 2 so as to face in the direction faced by the conditioning surface 2 and form protruding end surfaces in order that the above described 111 surface detection rate is obtained.

Furthermore, it is desirable that a tetrafluoride organic compound such as, for example, polytetrafluoro ethylene (PTFE), a tetrafluoroethylene—propylene hexafluoride copolymer resin (FEP), a tetrafluoroethylene—perfluoroalkyl vinyl ether copolymer resin (PFA), or a tetrafluoroethylene—ethylene copolymer resin (ETFE) is coated onto at least the surface of the grit layer 3 of the conditioning surface 2 onto which the diamond grit has been adhered. This tetrafluoride organic compound may be coated by implementing an electrodeposition coating process in which a CMP conditioner base metal 1 on whose conditioning surface 2 the grit layer 3 has been formed is immersed in a solution in which, for example, one of the aforementioned tetrafluoride organic compounds has been dispersed. Here, the tetrafluoride organic compound may be coated only on the end surfaces 4*f* and tapered surfaces 4*t* of the ring portion 4 and the end surfaces 5*f* of the projections 5 where the grit layer 3 is formed in the first, second, and fourth embodiments, or may be coated over the entire conditioning surface 2 in the first, second, and fourth embodiments, and also in the third embodiment.

Accordingly, in a CMP conditioner having the above described structure, in diamond grit that is adhered to the conditioning surface 2 and to the end surfaces 4*f* and 5*f* of the ring portion 4 and projections 5 thereof, 111 surfaces that are extremely strong and have excellent wear resistance are made substantially parallel with the conditioning surface 2, and are oriented to face in a direction faced by the polishing pad side of the CMP apparatus faced by this conditioning surface 2. Therefore, it is possible to ensure sharp cutting edges in the ridge lines and peak portions that form the edges of the cutting blades where the 111 surfaces and the crystal surfaces adjacent thereto intersect, and to control wear in the cutting blade portions and prevent breakages. As a result, it is possible to prevent the pad polishing rate from deteriorating markedly at an early stage, and to maintain a stable, high polishing rate for an extended period. In addition, scratches in semiconductor wafers and the like caused by fragments of broken grit can be prevented, which in turn enables high quality polishing with a small number of scratches to be performed on semiconductor wafers and the like that are polished using a CMP apparatus.

Moreover, because diamond grits that make it possible to prevent wear and breakages in cutting blade portions and in which 111 surfaces are in parallel with the conditioning surface 2 and face in a direction faced by the conditioning surface 2 are adhered such that the 111 surface detection rate is a high 70% or more, it is possible to more reliably maintain the aforementioned stable high pad polishing rate and prevent scratches from occurring. Namely, if the 111 surface detection rate is less than 70%, there is a possibility that the proportion of diamond grit in which the 111 surfaces and the ridge lines and peak portions between adjacent crystal surfaces face in the direction faced by the conditioning surface 2 will increase, and that the above described effect will not be sufficiently exhibited. Note that, when calculating the 111 surface detection rate by measuring the X-ray diffraction intensity of the diamond grit in this manner, there is a possibility that bias will occur in portions of the crystal surfaces on the conditioning surface 2 that face in the direction faced by the conditioning surface 2. Therefore, it is desirable that the X-ray diffraction intensity is measured at a plurality of measurement positions, and more desirably, at four or more measurement positions P such as the measurement positions P in the above described first through fourth embodiments, and that the average of these X-ray diffraction intensities is then taken.

Furthermore, as in the above described first and second embodiments, in a CMP conditioner in which the projections 5 are formed on the conditioning surface 2, and the diamond grits are adhered in the manner described above to the end surfaces 5*f* that face in the direction faced by the conditioning surface 2, because, at this time, a high polishing pressure is secured without the diamond grit completely covering the pad on the projections 5, it is possible to furnish the cutting blades with even sharper cutting edges and obtain an even higher cutting rate. In addition, this polishing rate can be maintained consistently for an extended period and the number of scratches can be kept even fewer. Moreover, in the first and second embodiments, because the ring portion 4 is formed on the outer circumferential side of the portions where the projections 5 are formed on the conditioning surface 2, and the diamond grits are also adhered to the end surface 4*f* thereof and to the tapered surface 4*t* on the outer circumferential side, the effect is also obtained that bending of the polishing pad can be controlled and the cutting blades can be made to bite even more effectively. However, if the projections 5 are formed in this manner, it is not necessary for the ring portion 4 to be formed.

Furthermore, if a tetrafluoride organic compound is coated onto at least the grit layer 3 where diamond grit has been adhered in the conditioning surface 2, as is described above, because this type of tetrafluoride organic compound is extremely corrosion resistant due to no $—CONH_2$, $—CH_2OH$, $—COOCH_8$, —COF, —COOH, and $—CCF_2H$ and the like, which easily react with highly corrosive chemicals, being present therein, even if highly corrosive slurry (i.e., grinding fluid) is used when the polishing pad of the CMP apparatus is being conditioned, it is still possible to stop the metal plating phase to which the diamond grit is adhered from corroding, and to prevent the diamond grit from falling off. Consequently, scratches that are caused by this as well as any deterioration in the polishing rate can be prevented. Moreover, by applying a coating of a tetrafluoride organic compound, even when, for example, what is known as a ceria based slurry, which is highly adhesive and in which fine particles of ceric oxide have been dispersed, is used, it is possible to prevent the fine particles conglomerating and adhering to the grit layer 3 of the conditioning surface 2, and it is consequently possible the diamond grit from biting into the pad because of these conglomerated and adhered fine particles and causing the polishing rate to deteriorate, and to prevent scratches from occurring as a result of conglomerated, adhered particles peeling off. Therefore, the effects of consistency in the pad polishing rate and prevention of scratching can be more reliably exhibited.

EXAMPLES

Next, the effects of the present invention will be demonstrated by giving examples of the present invention based on the above embodiments. In these examples, firstly, three types of CMP conditioner were manufactured by altering the particle size of the diamond grit based on the first embodiment, and two types of CMP conditioner were manufactured by altering the particle size of the diamond grit based on the second embodiment. These made up Examples 1 to 5. Examples 1 to 3 are based on the first embodiment and the particle size of the diamond grit was #100 in Example 1, #200 in Example 2, and #325 in Example 3. Examples 4 and 5 are based on the second embodiment and the particle size of the diamond grit was #100 in Example 4 and #325 in Example 5. The grit concentration was the number of pieces of diamond grit adhering per unit area (1 $mm^2$) in the grit layer 3 and was an average of 35 pieces of grit/$mm^2$ for a particle size of #100 (i.e., Examples 1 and 4), an average of 135 pieces of grit/$mm^2$ for a particle size of #200 (i.e., Example 2), and an average of 280 pieces of grit/$mm^2$ for a particle size of #325 (i.e., Examples 3 and 5).

Note that, in each of these Examples 1 to 5, the outer diameter of the conditioning surface 2 (i.e., the outer diameter of the base metal 1) was 101.6 mm, the inner diameter of the ring portion 4 was 90 mm, the outer diameter of the end surface 4*f* was 94 mm, the outer diameter of the ring portion 4 including the tapered surfaces 4*t* was 97 mm, and the protrusion height of the ring portions 4 and the projections 5 (i.e., the height of the end surfaces 4*f* and 5*f*) from the bottom surface 2*f* of the conditioning surface 2 was 0.3 mm in each case. Furthermore, in Examples 1 to 3 that are based on the first embodiment, the projections 5 have an outer diameter of 2 mm, and are arrayed as is shown in FIG. 1 in concentric circles at substantially equidistant intervals centered on the axis O, in a toroidal plane centered on the axis O that has an inner diameter of 67 mm and an outer diameter of 85 mm. In Examples 4 and 5 that are based on the second embodiment, the projections 5 have an outer diameter of 3 mm, and are arrayed as is shown in FIG. 2 in concentric circles at substantially equidistant intervals centered on the axis O, and also on the axis O.

In the same way, a CMP conditioner in which the particle size of the diamond grit was #100 was manufactured based on the third embodiment, and two CMP conditioners in which the particle size of the diamond grit was #100 and #200 were manufactured based on the fourth embodiment to give a total of three types of CMP conditioners. These made up Examples 6 to 8. However, in Examples 6 to 8 as well, the grit concentration, which, in the same way as in Examples 1 to 5, was the number of pieces of diamond grit adhering per unit area (1 $mm^2$) in the grit layer 3, was an average of 35 pieces of grit/$mm^2$ for a particle size of #100 (i.e., Examples 6 and 7) and an average of 135 pieces of grit/$mm^2$ for a particle size of #200 (i.e., Example 8. The outer diameter of the conditioning surface 2 (i.e., the outer diameter of the base metal 1) was also 101.6 mm, which was the same as in Examples 1 to 5. Furthermore, in Example 6 that was based on the third embodiment, the width of the beveled tapered surface 2*t* in a direction parallel to the conditioning surface 2 was 1.5 mm. The ring portion 4 in Examples 7 and 8 that were based on the fourth embodiment had a protrusion height form the bottom surface 2*f* of the conditioning surface 2 of 1 mm, while the inner diameter of the end surface 4*f* was 68.7 mm and the outer diameter thereof was 94.1 mm. The inner diameter of the ring portion 4 when the tapered surfaces 4*f* at the inner and outer circumferences thereof were included was 61.1 mm, while the outer diameter was the same as the outer diameter of the conditioning surface 2.

Note that, Examples 1 to 8 were manufactured using the following procedure. Namely, a group of diamond grit pieces that included a large number of hexahedral—octahedral grit or octahedral—hexahedral grit diamond grit pieces was observed under a microscope and selected from commercial artificial diamond grits, as is described above. These pieces were then dispersed in a Ni plating solution in which the base metal 1 was immersed and electroplating was performed such that a Ni plating phase was adhered by precipitation onto portions of the conditioning surface 2 where the grit layer 3 was to be formed.

Furthermore, the base metal 1 of the CMP conditioner that was manufactured in the same way as Example 1 was provided with an electrodeposition coating by being immersed in a solution in which a tetrafluoroethylene—perfluoroalkyl vinyl ether copolymer resin (PFA) having a molecular formula of —$(C_2F_4)m\cdot(ROCF{=}CF_2)_n$) has been dispersed as a tetrafluoride organic compound. As a result, a CMP conditioner was manufactured whose entire conditioning surface 2 was coated by the tetrafluoride organic compound. This was taken as Example 9. However, in Example 9, the thickness of the tetrafluoride organic compound coating was substantially 5 μm, and substantially 30% of the average particle diameter of the diamond grit protruded from this coated tetrafluoride organic compound.

In contrast, eight types of CMP conditioner were manufactured as comparative examples to compare with the above Examples 1 to 8. In Comparative examples 1 to 8, other than the fact that the diamond grit was not specially selected as it was in Examples 1 to 8, diamond grit having the same particle size was adhered onto the same base metal 1 as in Examples 1 to 8. These comparative examples were taken as Comparative examples 1 to 8 and were matched with the above Examples 1 to 8. In addition, a CMP conditioner was manufactured in which a tetrafluoride organic compound (tetrafluoroethylene—perfluoroalkyl vinyl ether copolymer resin) was coated under the same conditions as in Example 9 onto a CMP conditioner that was manufactured in the same way as in Comparative example 1, and this was taken as Comparative example 9.

For these Examples 1 to 8 and Comparative examples 1 to 8, the X-ray diffraction intensity of 111 surfaces of the diamond grit and the X-ray diffraction intensity of other crystal surfaces were measured at a plurality (four) measurement positions P that were located at equal intervals of 90° in a circumferential direction around the axis O within a range such that they did not encroach beyond the end surfaces 4*f* and 5*f* that were parallel with the bottom surface 2*f* located at the outermost circumferential side of the conditioning surface 2 (i.e., within a range such that they did not encroach beyond the circular ridge line between the end surface f4 and the outer circumferential side tapered surface 4*t* of the ring portion 4 in Examples 1 to 5, 7, and 8 that are based on the first, second, and fourth embodiments in which the ring portion 4 is formed at the outermost circumference; and within a range such that they did not encroach beyond the circular ridge line between the conditioning surface 2 and the beveled tapered surface 2*t* in Example 6 that is based on the third embodiment), as is shown in FIGS. 1 through 4. In addition, the measurement positions P were substantially in contact with the inner side of the above described ridge lines. Based on these measurements, 111 surface detection rates were calculated and the results are shown in table 1 as an average of the four measurement positions P. Note that the measuring device used in this measurement of the X-ray diffraction intensity was a RINT 2000/ULTIMA+ model manufactured by Rigaku Mechatronics (Ltd.) in which the vessel used (i.e., target) was Cu(Kα), the voltage was 40 kV, the current was 40 mA, the slit was 1°-0.3 mm-1°, the measurement range was 2θ=35° to 145°, the step width was 0.02°, the scan speed was 3°/mm, and the spot diameter was 10 mm.

In addition, while conditioning of the polishing pad was being performed in a CMP apparatus by the respective CMP conditioners of Examples 1 to 9 and Comparative examples 1 to 9, polishing of Si wafers was performed by the relevant CMP apparatus and the number of scratches generated in the polished surfaces of the wafers after a period of 100 hours from the commencement of the conditioning, as well as changes in the pad polishing rate at predetermined times (i.e., after 30 minutes, and 5, 10, 20, 50, and 100 hours) during this period were measured. These results are also shown in Table 1. The polishing conditions in the conditionings in Examples 1 to 8 and Comparative examples 1 to 8 were: pad revolution speed was 80 rpm; CMP conditioner revolution speed 80 rpm; oscillation speed was 3000 mm/min; load was 49N; pad outer diameter was 360 mm; pad material was polyurethane; and 100 ml/min of water was used as the slurry.

TABLE 1

| | 111 surface (cps) | 220 surface (cps) | 311 surface (cps) | 222 surface (cps) | 400 surface (cps) | 311 surface (cps) | 111 surface detection rate (%) |
|---|---|---|---|---|---|---|---|
| Example 1 | 1583 | 29 | 317 | — | 184 | — | 75 |
| Comparative example 1 | 327 | 65 | 4 | 11 | 893 | 5 | 25 |
| Example 2 | 2900 | 17 | 19 | — | 1090 | — | 72 |
| Comparative example 2 | 696 | 10 | 374 | — | 5 | 8 | 64 |
| Example 3 | 2947 | — | 34 | — | 245 | — | 91 |
| Comparative example 3 | 893 | 2 | 2 | 3 | 25 | 662 | 56 |
| Example 4 | 1683 | 33 | 309 | — | 178 | — | 76 |
| Comparative example 4 | 308 | 68 | — | 10 | 900 | 2 | 24 |
| Example 5 | 3043 | — | 30 | — | 230 | — | 92 |
| Comparative example 5 | 850 | — | — | — | 35 | 680 | 54 |
| Example 6 | 2200 | 40 | 350 | — | 170 | — | 80 |
| Comparative example 6 | 400 | 78 | 9 | — | 200 | — | 58 |
| Example 7 | 1890 | 36 | 330 | 5 | 173 | — | 78 |
| Comparative example 7 | 546 | 54 | 17 | — | 190 | — | 68 |
| Example 8 | 2986 | 13 | 15 | 10 | 930 | — | 76 |
| Comparative example 8 | 870 | 18 | 20 | 79 | 1200 | — | 41 |
| Example 9 | 2900 | — | — | — | 198 | — | 94 |
| Comparative example 9 | 948 | 57 | 57 | 58 | 80 | 717 | 49 |

| | | Pad polishing rate (μm/h) | | | | | |
|---|---|---|---|---|---|---|---|
| | Number of scratches | After 30 mins | After 5 hours | After 10 hours | After 20 hours | After 50 hours | After 100 hours |
| Example 1 | 0 | 35 | 37 | 34 | 30 | 25 | 22 |
| Comparative example 1 | 11 | 42 | 39 | 34 | 30 | 23 | 18 |
| Example 2 | 0 | 21 | 23 | 22 | 20 | 18 | 14 |
| Comparative example 2 | 6 | 27 | 24 | 21 | 18 | 14 | 9 |
| Example 3 | 0 | 15 | 17 | 19 | 16 | 11 | 6 |
| Comparative example 3 | 9 | 20 | 18 | 15 | 10 | 8 | 3 |
| Example 4 | 0 | 30 | 28 | 27 | 27 | 24 | 20 |
| Comparative example 4 | 7 | 33 | 29 | 25 | 22 | 20 | 18 |
| Example 5 | 0 | 13 | 13 | 11 | 10 | 10 | 10 |
| Comparative example 5 | 4 | 15 | 12 | 10 | 9 | 5 | 5 |
| Example 6 | 3 | 15 | 17 | 15 | 14 | 10 | 10 |
| Comparative example 6 | 15 | 18 | 18 | 14 | 10 | 8 | 8 |
| Example 7 | 2 | 23 | 23 | 20 | 19 | 17 | 14 |
| Comparative example 7 | 14 | 27 | 24 | 22 | 18 | 16 | 10 |
| Example 8 | 4 | 15 | 16 | 13 | 12 | 13 | 10 |
| Comparative example 8 | 10 | 17 | 15 | 12 | 10 | 8 | 4 |
| Example 9 | 0 | 10 | 12 | 9 | 9 | 6 | 5 |
| Comparative example 9 | 5 | 16 | 13 | 8 | 4 | 2 | 2 |

From the results shown in Table 1, firstly, if a comparison is made between Examples 1 to 8 and Comparative examples 1 to 8 in which diamond grit having the same particle size is adhered in the same patterns on the conditioning surfaces 2 of the same base metal 1, then in the CMP conditioners of Examples 1 to 8 in which a 111 surface detection rate of 70% or more was obtained the number of scratches is markedly less than in the CMP conditioners of Comparative examples 1 to 8 in which a 111 surface detection rate of less than 70% was obtained. In particular, in Examples 1 to 5 in which the diamond grit was adhered with the projections 5 being formed on the conditioning surface 2, the number of scratches generated was zero.

When the pad polishing rates were compared, although the polishing rate was somewhat higher in all of the Comparative examples in the early stages of conditioning, at some point between 5 and 10 hours after the conditioning commenced, the polishing rate in the Comparative examples rapidly deteriorated and became either equal to the Examples or else a higher polishing rate was obtained from the Examples. In contrast, in the Examples, after 5 hours had passed, the polishing rate was the same as at the conditioning commencement or else had improved slightly. Subsequently, the deteriorating trend progressed substantially unabated in Comparative examples 1 to 8, while the deteriorating trend was kept stable at a small level in Examples 1 to 8. After 100 hours had passed, all of the Examples provided a higher polishing rate compared to the Comparative examples.

Furthermore, when a comparison was made between Examples 1, 4, 6, and 7 in which the same #100 particle size diamond grit was adhered and the 111 surface detection rate was 70% or more, in Examples 1 and 4 in which diamond grit was adhered to the projections 5, the number of scratches was fewer than in Example 6 in which diamond grit was adhered to the entire surface of the conditioning surface 2 and than in Example 7 in which only the ring portion 4 was formed on the conditioning surface 2 and diamond grit was adhered thereto. Moreover, the pad polishing rate exhibited excellent results throughout a period of 100 hours from the conditioning commencement.

Next, in the conditioning in Example 9 and Comparative example 9, the polishing conditions were set at: pad revolution speed was 40 rpm; CMP conditioner revolution speed was 40 rpm; load was 80N; and pad outer diameter was 380 mm. In addition, the above described ceria based slurry was used as the slurry. At this time, the number of scratches until a point 100 hours from the commencement of the conditioning, as well as changes in the pad polishing rate at predetermined times (i.e., after 30 minutes, and 5, 10, 20, 50, and 100 hours) during this period were measured. These results are also shown in Table 1.

As regards the pad polishing rate, in the same way as in Comparative examples 1 to 8, in the CMP conditioner of Comparative example 9 as well, although the polishing rate was higher than for the CMP conditioner of Example 9 in the early stages of conditioning, there was a sizeable deteriorating trend each hour, and at some point between 5 and 10 hours after the conditioning commenced, the results were reversed compared to Example 9. Moreover, scratches were generated though fewer than in Comparative example 1.

In contrast to this, in the CMP conditioner of Example 9, no scratches were generated, and when the conditioning surface 2 was observed after the polishing had ended, no ceric oxide particle conglomeration or adhesion was observed. In addition, the rate of reduction in the pad polishing rate was kept at a lesser level than in Comparative example 9, and even when a ceria based slurry like that described above was used, corrosion of the grit layer 3 was controlled and stable conditioning was possible.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A CMP conditioner in which diamond grit is adhered to a conditioning surface that faces and is in contact with a polishing pad of a CMP apparatus, wherein the diamond grit is adhered such that 111 surfaces of crystal surfaces of the diamond grit are substantially parallel with the conditioning surface and face in a direction faced by the conditioning surface.

2. The CMP conditioner according to claim 1, wherein, on the conditioning surface, a ratio of an X-ray diffraction intensity of the 111 crystal surfaces to a sum of the X-ray diffraction intensity of all measured crystal surfaces when an X-ray diffraction intensity of crystal surfaces of the diamond grit is measured at a plurality of measurement positions on the conditioning surface averages 70% or more at the plurality of measurement positions.

3. The CMP conditioner according to claim 1, wherein a plurality of projections are formed on the conditioning surface and the diamond grit is adhered to the projections.

4. The CMP conditioner according to claim 2, wherein a plurality of projections are formed on the conditioning surface and the diamond grit is adhered to the projections.

5. The CMP conditioner according to claim 1, wherein a tetrafluoride organic compound is coated on the conditioning surface.

6. The CMP conditioner according to claim 2, wherein a tetrafluoride organic compound is coated on the conditioning surface.

7. The CMP conditioner according to claim 3, wherein a tetrafluoride organic compound is coated on the conditioning surface.

8. The CMP conditioner according to claim 4, wherein a tetrafluoride organic compound is coated on the conditioning surface.

* * * * *